US012590353B2

(12) United States Patent
Pan et al.

(10) Patent No.: US 12,590,353 B2
(45) Date of Patent: Mar. 31, 2026

(54) PROCESS FOR THE RECOVERY OF HIGH PURITY METALLIC SODIUM AND THE SAFE TREATMENT OF HIGH CALCIUM CONTENT SODIUM SLAG

(71) Applicants: BEIJING UNIVERSITY OF CHEMICAL TECHNOLOGY, Beijing (CN); INNER MONGOLIA RUIXIN CHEMICAL CO., LTD, Inner Mongolia (CN)

(72) Inventors: Junqing Pan, Beijing (CN); Qiuchen Wang, Beijing (CN); Keyu Wang, Beijing (CN); Yan Chen, Inner Mongolia (CN); Yanzhi Sun, Beijing (CN)

(73) Assignees: BEIJING UNIVERSITY OF CHEMICAL TECHNOLOGY, Beijing (CN); INNER MONGOLIA RUIXIN CHEMICAL CO., LTD, Inner Mongolia (CN)

( * ) Notice: Subject to any disclaimer, the term of this patent is extended or adjusted under 35 U.S.C. 154(b) by 737 days.

(21) Appl. No.: 18/070,242

(22) Filed: Nov. 28, 2022

(65) Prior Publication Data

US 2023/0332270 A1 Oct. 19, 2023

(30) Foreign Application Priority Data

Apr. 14, 2022 (CN) ..... 202210393085.9

(51) Int. Cl.
*C22B 26/10* (2006.01)
*C22B 1/02* (2006.01)
(Continued)

(52) U.S. Cl.
CPC ..... *C22B 26/10* (2013.01); *C22B 1/02* (2013.01); *C22B 3/12* (2013.01); *C22B 7/008* (2013.01)

(58) Field of Classification Search
None
See application file for complete search history.

(56) References Cited

U.S. PATENT DOCUMENTS 12,392,013 B2 * 8/2025 Pan ..... C22B 7/008

FOREIGN PATENT DOCUMENTS

CN 1238541 C 12/1999
CN 1239722 C 2/2006
(Continued)

OTHER PUBLICATIONS

INTECH GmbH. Examples of centrifuge calculations, 2025. Retrieved electronically at https://intech-gmbh.ru/en/centrifuges_calc_examples/ on Sep. 24, 2025. (Year: 2025).*
(Continued)

*Primary Examiner* — Anthony J Zimmer
*Assistant Examiner* — Zachary John Baum
(74) *Attorney, Agent, or Firm* — Maine Cernota & Curran

(57) ABSTRACT

The present disclosure relates to the field of non-ferrous metal and chemical industries for the production of metal sodium, and discloses a process for the preparation of high purity metallic sodium and the safe treatment of high calcium content sodium slag, the process comprises the following steps: (1) subjecting a liquid sodium obtained from electrolysis to a supergravity separation to obtain a high purity metallic sodium and a high calcium content sodium slag; (2) subjecting said high calcium content sodium slag to at least one roasting process to obtain a roasting slag; (3) leaching said roasting slag with an alkaline liquor to produce sodium hydroxide solution and calcium
(Continued)

hydroxide. The process provided by the present disclosure not only greatly reduces the amount of generated sodium slag, but also implements the safe recovery of calcium and sodium resources from the sodium slag.

18 Claims, 5 Drawing Sheets
(3 of 5 Drawing Sheet(s) Filed in Color)

(51) Int. Cl.
*C22B 3/12* (2006.01)
*C22B 7/00* (2006.01)

(56) References Cited

FOREIGN PATENT DOCUMENTS

| | | | |
|---|---|---|---|
| CN | 201209160 Y | * | 3/2009 |
| CN | 103667708 A | | 3/2014 |
| CN | 104805469 B | | 7/2015 |
| CN | 108048872 A | | 5/2018 |
| CN | 211011407 U | * | 7/2020 |

OTHER PUBLICATIONS

English translation of CN-201209160-Y. (Year: 2009).*
English translation of CN-211011407-U. (Year: 2020).*
Najafpour, Ghasem D.. (2015). Biochemical Engineering and Biotechnology (2nd Edition)—7.4.1 Theory of Centrifugation. Elsevier. Retrieved from https://app.knovel.com/hotlink/pdf/id:kt0114JTK4/biochemical-engineering/theory-centrifugation on Sep. 24, 2025. (Year: 2015).*
Nie Jianzhou, "Formation reason and purification method of impurity calcium in metallic sodium" (1994)—Ningxia Yinchuan Sodium Factory, 8 pages.
"Diaphragm Method Electrolysis of Sodium Chloride and High Purity Sodium and Sodium Hydroxide" (1984) Journal of Hunan University vol. 11 No. 2.
Wang Miao "The Development of High Purity Sodium Electrolysis Device" Shanghai University of Applied Technology, May 22, 2015, Shanghai China, 63 pages.

* cited by examiner

PROCESS FOR THE RECOVERY OF HIGH PURITY METALLIC SODIUM AND THE SAFE TREATMENT OF HIGH CALCIUM CONTENT SODIUM SLAG

RELATED APPLICATIONS

This application claims the priority of CN Patent Application 202210393085.9, filed Apr. 14, 2022. This application is herein incorporated by reference, in its entirety, for all purposes.

FIELD

The present disclosure relates to the field of non-ferrous metal and chemical industries for the production of sodium metal, and more particularly to separate high purity metallic sodium from the mixture of sodium metal containing a small amount of calcium metal which produced from a sodium chloride electrolytic process high purity metallic sodium, and performing safe treatment of the high calcium-containing sodium slag and recover the contained sodium and calcium resources.

BACKGROUND

Metallic sodium is a common alkali metal, it is a silver-white metal composed of equiaxed cubic crystals, and exhibits extremely active chemical properties and powerful reducing properties. Metal sodium is widely used as a strong reducing agent in refractory metals such as titanium, zirconium, niobium and chemical industries, and has widespread applications in oil desulfurization and dyeing industries. Metal sodium also has a low melting point and desirable electrical and thermal conductivity, such that sodium has won important applications in high-efficiency coolants for the nuclear power industry, sodium cables, sodium lamps and other aspects. In recent years, due to the improvement of the production process of metal sodium, the production yield of indigo dyes and pharmaceutical intermediates in China has been gradually expanded, and China has been the major supplier of indigo. According to statistics, the metal sodium production in mainland China was more than 100,000 tons in 2019, becoming the largest producer of metal sodium in the world. China has vigorously developed the environmentally friendly and green economy with the goals of realizing "Carbon peaking" in 2030 and "Carbon neutralization" in 2060, the application areas of metal sodium, especially high-purity metal sodium, will further comprise titanium alloys, high-efficiency catalysts in the petrochemical industry, sodium-sulfur battery cells, sodium salt battery cells, fast neutron breeder reactors, and sodium azide decomposers for airbags and the like.

The existing production process of metal sodium in China includes the tetra-anodic electrolysis process voluntarily which is proposed by J. C. Downs and Dopunt Incorporation in the United States. This method was introduced by a portion of mainland China enterprises and then developed by the Beijing Chemical Machinery Factory. The existing electrolysis process has been subjected to many modifications, and exhibits the advantages of stable process and reliable quality, but there is a problem that the adding of calcium chloride and barium chloride as fluxing agent during the electrolysis process. The two salts have significantly lowered the electrolysis temperature to facilitate the stratification of metal sodium and molten salts. However, a small number of calcium ions are simultaneously reduced on the cathode accompanied by the sodium ions during the electrolysis process, resulting in the increased calcium content of 0.7-1.1% in the liquid sodium. After the liquid sodium is purified by standing process in a conical refining tower, the calcium content is reduced to 0.1-0.3%, and metal sodium purity reaches 99.5-99.8%, which can meet most of the calcium insensitive industrial requirements of sodium. In recent years, the low purity metal sodium seriously affects the product quality in some circumstances of the special pharmaceutical, energy storage and nuclear industries, and even triggers the safety problems. Therefore, the development of a novel manufacturing process of high purity metallic sodium is of great socio-economic value to meet the requirements of high purity metallic sodium from the emerging industries such as fine chemicals, sodium sulfur battery and nuclear industry.

The purification process of metal sodium, which is widely used in modern industry, is essentially a discontinuous separation process for removing impurities (e.g., calcium) in liquid sodium by taking advantage of natural gravity, the process has the defects such as low production efficiency and poor separation efficiency, and reduced yield in a long time separation process resulting from the oxidization of a part of the metal sodium. For example, the process generates a large amount of sodium slag containing metal sodium and calcium during the purification process, which is 1-2% of the production of metal sodium. Nie Jianzhou, Ningxia Chemical, 1994 (3) pp. 12-14 reports the purification process of crude sodium by using the intermittent or continuous mode to remove calcium, so as to reduce the calcium content from 1% to 0.01%. However, the process has the defects such as a long time of the standing process and heat preservation and the dangerous effect of calcium removal. In order to improve the purity of metal sodium, there are many well-known enterprises that carry out research for purifying liquid sodium. For instance, the China patent application CN1239722C discloses that the MSSA Company in France adopts a solution of contacting liquid sodium with the gas containing water vapor, so as to oxidize a part of the metallic calcium into calcium oxide. Related reports such as the China patent CN1238541C uses sodium peroxide to replace water vapor to oxidize calcium in crude sodium, and then produces the purified sodium through the sedimentation-filtration and cold trap purification process. In addition, the China patent CN108048872A discloses a method of preparing the refined sodium by filtering the calcium impurities in crude sodium through ceramic membranes at a high temperature of 350° C. The distillation is also an effective process for purifying metal sodium by taking advantage of the low boiling point property of metal sodium. For example, China patent CN103667708B reports the process of heating metal sodium in a heating furnace to obtain a sodium vapor, and then condensing the sodium vapor to obtain metal sodium having a purity of 99.9%. It is also the research with important significance to develop a novel process for preparing metal sodium, thereby substantially improving the purity of metal sodium. For example, Zongzhang Chen, et al. reports the process of electrolyzing sodium chloride to obtain metal sodium having a high purity using β-alumina solid electrolyte tube in the *Journal of Hunan University,* 1984, 11(2), pp. 95-105. Then Miao Wang and Quansheng Zhang have reported in 2015 ("Development of Electrolysis Unit for Producing High purity metallic sodium", Shanghai Institute of Technology, Master's thesis) and the China patent CN104805469B also report the process of electrolyzing sodium chloride with the β-alumina solid electrolyte tube to produce metal sodium having a high purity. The process of electrolyzing sodium with the β-alumina solid electrolyte tube is a new electrolysis process which is very energy-saving, and can directly obtain a high purity metallic sodium having a purity of 99.9% or more. In the past 40 years, the researchers have found that it is still difficult to overcome the problems of increasing the service life of solid electrolyte tube, preventing the cracking of the electrolysis process, and preparing the large-sized solid electrolyte tube, resulting in the unindustrialized application of this method.

To sum up, many of the theses and patents mentioned above use high temperature sodium vapor or flammable explosive materials (e.g., hydrogen gas) in the process of preparing pure metallic sodium, and the operations such as high-temperature filtration, which increase difficulty of the practical applicability of the patent technology for purifying the metal sodium. In addition, the above-mentioned technologies in the theses and patents do not sufficiently consider how to safely dispose of the valuable resources in the sodium slag generated from the purification process, which sharply increases the massive accumulation of the sodium slag, leading to new security risks. Concerning the existing methods of the preparation of metallic sodium through electrolysis of sodium chloride, there are many difficult problems shall be urgently solved by the metal sodium industry, namely how to invent the new electrolysis process or separation method to construct a continuous and efficient separation process of high purity metallic sodium and calcium, and perform safe treatment of the new type of sodium slag generated from the manufacturing process and recovery of the sodium and calcium resources.

SUMMARY

The present disclosure aims to solve the defects of the reported methods, and provides a process for the recovery of high purity metallic sodium and the safe treatment of high calcium content sodium slag. The proposed strategy not only greatly reduces the amount of generated sodium slag, but also realizes the safe recovery of calcium and sodium resources from the sodium slag.

The present disclosure provides a process for the recovery of high purity metallic sodium and the safe treatment of high calcium content sodium slag, the process comprises the following steps:

(1) Subjecting a liquid sodium obtained from an electrolysis to a supergravity separation to obtain a high purity metallic sodium and a high calcium content sodium slag;

(2) Subjecting said high calcium content sodium slag to at least one roasting process to obtain a roasting slag;

(3) Leaching said roasting slag with an alkaline liquor to produce sodium hydroxide solution and calcium hydroxide.

The liquid sodium obtained by electrolysis of the present disclosure contains Na and Ca, preferably the liquid sodium contains Na in an amount of 95-99.9 wt % and Ca in an amount of 0.1-5 wt %, based on the total amount of the liquid sodium.

Preferably, Na is contained in an amount of 98-99.7 wt % and Ca is contained in an amount of 0.3-2 wt %, based on the total amount of the liquid sodium.

The present disclosure provides a method for directly subjecting liquid sodium obtained from electrolysis to the supergravity separation, which produces a sodium slag characterized by a calcium content up to 25-50%, which is higher than the calcium content 8-20% of the typical sodium slag produced by the conventional natural settling; therefore, for the sake of favorably distinguishing and describing the new sodium slag produced by the present disclosure and the sodium slag derived from the conventional process, the present disclosure subsequently defines the sodium slag generated from the new process as a high calcium content sodium slag. The present disclosure improves the calcium separation efficiency during the production process, so that the calcium content can be raised to 25-50% from the calcium content of 10-20% in the existing sodium slag.

The process provided by the present disclosure have the advantages, such as high separation efficiency of sodium and calcium, saving separation time, safe and controllable production process, continuous production, thus the present disclosure provides a safe and efficient method for preparation of high purity metallic sodium and safe treatment of new high calcium content sodium slag generated during the process, thereby performing the continuous preparation of high purity metallic sodium and high value disposal of high calcium content sodium slag.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
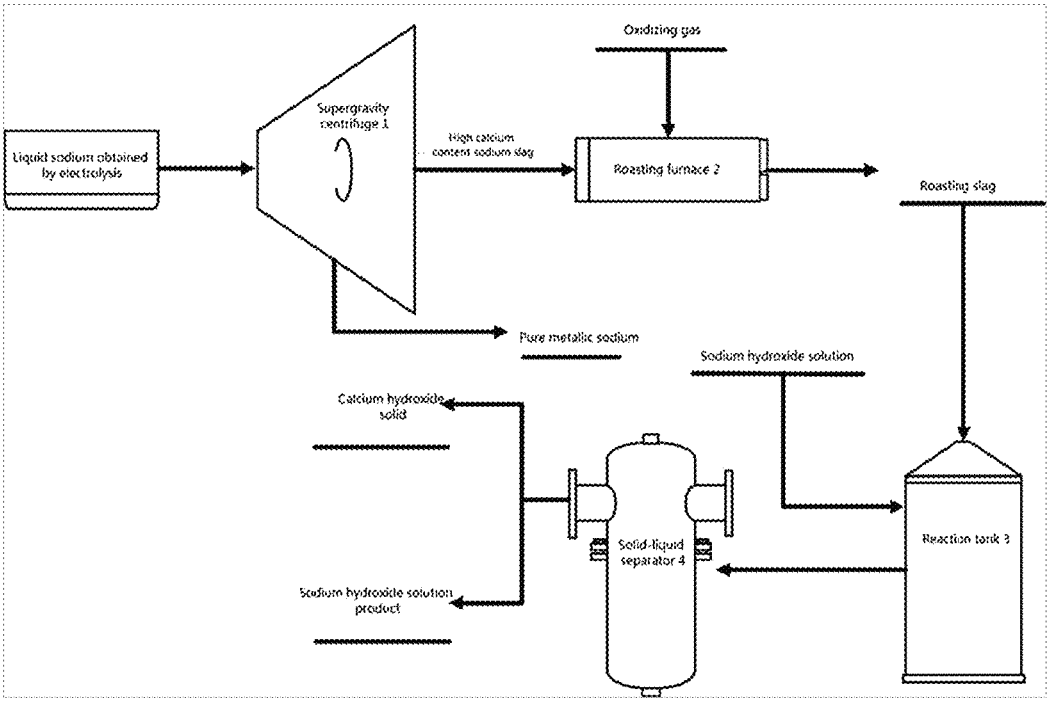
FIG. 1 illustrates a flow diagram of the centrifugation—first roasting—leaching for sodium metal of the present disclosure.

The terminals and any value of the ranges disclosed herein are not limited to the precise ranges or values, such ranges or values shall be comprehended as comprising the values adjacent to the ranges or values. As for numerical ranges, the endpoint values of the various ranges, the endpoint values and the individual point value of the various ranges, and the individual point values may be combined with one another to produce one or more new numerical ranges, which should be deemed have been specifically disclosed herein.

In the description of the present disclosure, unless otherwise specified, it shall be comprehended that the orientation or positional relationship indicated by the terms "central", "longitudinal", "lateral", "length", "width", "thickness", "upper", "lower", "left", "right", "vertical", "horizontal", "top", "bottom", "axial", "radial", "circumferential" and the like refer to the orientation or positional relationship illustrated based on the appended drawings, the terms are merely used for convenience in describing the present disclosure and simplifying the description, instead of indicating or implying that the apparatus or components thereof must be disposed with a specific orientation, constructed and operated with a particular orientation, thus the terms shall not be considered as imposing a limitation to the present disclosure. Furthermore, the terms "inside" and "outside" refer to the inside and outside relative to the profiles of the respective element per se.

Unless otherwise specified in the present disclosure, the terms associated with connection, such as "connected" and "interconnected", refer to a relationship of fixed or connected with each other of the structures, either directly or indirectly through an intermediate structure, as well as the relationship of movable or rigid connection.

As used herein, when an element or a component or a unit is referred to as being "connected to", "coupled with" or "contacting" another element or component or unit, the element or component or unit may be directly connected to, directly coupled with or directly contacting a particular element or component or unit, or connected to, coupled with or contacting a particular element or component or unit through one or more intermediate elements or components or units. When an element is referred to as being "directly connected", "directly coupled", or "directly contacting" another element, there is not any intermediate element or component or unit therebetween.

The term "fluidly coupled to" or "fluidly coupled" used herein shall be understood as a component connected to a pipe or pipeline and configured to allow a gas or liquid to flow through the component.

The term "ambient temperature" described herein shall be comprehended as a temperature under ambient conditions, e.g. room temperature of 20-25° C.

The expressions "first" and "second" described herein merely serve to distinguish between the materials that are used or the operations that are implemented in the different steps or stages, are not intended to impose limitation to the particular material or operation.

In the present disclosure, where the values are expressed as approximations by using an antecedent "about", it shall be understood that the particular values form another embodiment. As used herein, "about X" (wherein X is a numerical value) preferably means a range of ±10% around the cited value, including the endpoints. For example, the phrase "about 8" preferably refers to a value within the range of 7.2-8.8, inclusive of the endpoints 7.2 and 8.8. When the antecedent "about" is present, all ranges are inclusive and combinable. For example, when a range of "1 to 5" is listed, the cited range should be interpreted to include the ranges "1 to 4", "1 to 3", "1-2 and 4-5", "1-3 and 5", "2-5", etc. Furthermore, when a list of alternatives is provided, the list may be interpreted to mean that any of the alternatives can be excluded, e.g., by a negative limitation in the claims. For example, when a range of "1 to 5" is recited, the recited range may be interpreted to include instances where any of 1, 2, 3, 4, or 5 is negatively excluded; thus a recitation of "1 to 5" may be interpreted to include "1 and 3-5, but not 2", or be simply construed as "wherein 2 is excluded". It means that any component, element, attribute, or step expressly recited herein may be excluded from the claims, regardless of the components, elements, attributes, or steps are listed as alternatives or they are individually cited.

The term "substantially" or "substantially the same" used herein, unless otherwise specified, shall be understood to encompass a parameter having a fluctuation within a suitable range, e.g., ±10% or ±15% fluctuation of the parameter. In some embodiments, the fluctuation range is within ±10%.

Unless otherwise expressly stated, the terms "optionally" or "selectively" used herein mean that the action may be performed or not performed, or that the material is added or not added.

In the present disclosure, when a gas concentration is concerned, such as "oxygen concentration", it refers to the volume concentration of the gas unless otherwise specified.

In a first aspect, the present disclosure provides a process for the recovery of high purity metallic sodium and the safe treatment of high calcium content sodium slag, as shown in FIG. 1, the process comprises the following steps:

(1) Subjecting a liquid sodium obtained from an electrolysis to a supergravity separation to obtain a high purity metallic sodium and a high calcium content sodium slag;

(2) Subjecting said high calcium content sodium slag to at least one roasting process to obtain a roasting slag;

(3) Leaching said roasting slag with an alkaline liquor to produce sodium hydroxide solution and calcium hydroxide.

The process for the preparation of high purity metallic sodium and the safe treatment of high calcium content sodium slag provided by the present disclosure directly introduces the electrolyzed liquid sodium to the supergravity environment to carry out settling separation, thereby obtaining high purity metallic sodium and high calcium content sodium slag, and omitting the operation of natural settling separation in the prior art, the inventors of the present disclosure found during the course of researches that an use of the process provided by the present disclosure not only greatly increases the treatment efficiency, but also improves the separation efficiency.

The liquid sodium in the process of the present disclosure may be liquid sodium obtained from various electrolysis processes in the art. Preferably, the liquid sodium contains Na in an amount of 95-99.9 wt % and Ca in an amount of 0.1-5 wt %, based on the total amount of the liquid sodium; more preferably, Na is contained in an amount of 98-99.7 wt % and Ca is contained in an amount of 0.3-2 wt %, based on the total amount of the liquid sodium.

The method of disposing the high calcium content sodium slag provided by the present disclosure is also applicable to the existing industrial recovery of sodium slag, wherein the high calcium content sodium slag may be a directly obtained industrial sodium slag, preferably a dangerous waste sodium slag generated from the electrolysis process of sodium chloride to produce metal sodium, or a sodium slag treated by the prior art. That is, preferably, the high calcium content sodium slag in step (2) according to the present disclosure may be mixed with a sodium slag obtained by the prior art and then co-treated to carry out the roasting process.

The present disclosure provides a process for subjecting the liquid sodium obtained from the electrolysis directly to a supergravity separation, it produces better separation effect and high separation efficiency.

In order to favorably achieve the supergravity separation effect of the present disclosure, the inventors of the present disclosure have discovered during the research process that the selection of an appropriate centrifugation separation factor, a centrifugation time and a centrifugation temperature are more advantageous for achieving the separation of sodium and calcium to the maximum extent, to obtain high purity metallic sodium and high calcium content sodium slag; preferably, a separation factor Fr of said supergravity centrifugation in step (1) is within a range of 100-10,000, preferably 500-4,500, more preferably 1,500-4,500.

Preferably, the supergravity centrifugation is carried out for a time within a range of 0.1-100 min, preferably 2-20 min, such as 2 min, 5 min, 10 min, 15 min, 20 min, or an arbitrary value between any two thereof, more preferably 2-10 min.

Preferably, the centrifugation temperature of the supergravity centrifuge is within a range of 100-420° C., preferably 110-240° C.

By optimizing the conditions of the supergravity separation, the present disclosure obtains high purity metallic sodium while reducing the amount of sodium lost from the high calcium content sodium slag as far as possible, thereby improving resource efficiency. The separated liquid sodium (high purity metallic sodium) can be produced into sodium ingots, and the corresponding high calcium content sodium slag is put into a subsequent stage of safe treatment for recovering the sodium and calcium resources therein by means of the roasting-leaching process.

According to a preferred embodiment of the present disclosure, the high calcium content sodium slag contains Na and Ca; preferably, Na is contained in an amount of 50-75 wt % and Ca is contained in an amount of 25-50 wt %, based on the total amount of named high calcium content sodium slag. In addition to Na and Ca, the high calcium content sodium slag in the process provided by the present disclosure does not exclude other metal elements including, but not limited to, barium, magnesium and potassium, contained in the small amounts (e.g., not more than 2%). Moreover, the present disclosure does not impose particular limitation to the forms of Na and Ca present in the high calcium content sodium slag, the various forms of the high calcium content sodium slag containing Na and Ca are suitable for the recovery method provided in the present disclosure.

The present disclosure does not impose particular limitation to the purity of high purity metallic sodium, provided that the high purity metallic sodium having a higher purity can be obtained by the above-mentioned preferred supergravity separation conditions, preferably, the sodium content of the high purity metallic sodium is 99.8 wt % or more.

Preferably, the roasting of step (2) is a controllable oxygen roasting, which enables a conversion of high calcium content sodium slag to sodium peroxide, sodium oxide, calcium oxide and residual sodium calcium slag under the premise of satisfying the safe operation. Preferably, the controllable oxygen roasting is carried out under the controlled oxygen gas supply conditions. The oxygen gas supply comprises, unless otherwise specified, a combined control of oxygen gas concentration and/or oxygen gas flow rate. The present disclosure proposes to safely provide a controllable roasting of sodium slag, by using the hourly oxygen gas flow per ton of the high calcium content sodium slag (i.e., $m^3/t \cdot min$) as the measuring unit so as to accurately measure and control the roasting speed of oxygen gas and heat dissipation speed during the roasting process. Experiments have shown that the measuring unit is a complex unit, its further and effective combination with oxygen concentration can fulfill the purpose of controllable roasting. Preferably, the flow rate of the oxygen component during the controllable roasting process is within a range of 0.5-200 $m^3/t \cdot min$, more preferably 1-150 $m^3/t \cdot min$. The oxygen component refers to the content of oxygen component in the air or an oxygen deficient air or an artificial gas mixture.

According to a preferred embodiment of the present disclosure, an oxygen concentration during the roasting process is within a range of 5-40%, preferably 10-30%.

Preferably, the roasting temperature is within a range of 220-750° C., more preferably within a range of 240-450° C.

Preferably, the roasting is carried out for 5-180 min, preferably 10-90 minutes, such as 10 min, 20 min, 30 min, 40 min, 50 min, 60 min, 70 min, 80 min, 90 min, or an arbitrary value between any two thereof.

The inventors have discovered in the research that the high calcium content sodium slag is significantly different from the existing sodium slag in the roasting process, it is necessary to reconsider the oxygen gas supply amount and combustion temperature as well as the staged combustion mode according to the characteristic of high calcium content in said high calcium content sodium slag, thereby ensuring the stable combustion of the high calcium content sodium slag. Therefore, the process of roasting the high calcium content sodium slag may be the controlled roasting under the strict control of oxidation conditions such as the oxygen supply, roasting temperature, roasting time and oxygen concentration, the process is either more conducive to promoting maximum conversion of the high calcium content sodium slag to sodium oxide and calcium oxide, or more advantageously to achieving the controllable order and safety of the roasting process. Preferably, the skilled person in the art can divide the roasting process into the single roasting, twice roasting or multiple roasting during the practical process according to the size of the roasting amount.

According to a preferred embodiment of the present disclosure, the number of roasting process in step (2) is 1-4 times, preferably 1-3 times. The roasting process is specifically described hereinafter for the sake of facilitating comprehension, it can be understood that the following description does not impose limitation to the present disclosure. In particular, the single roasting process may be used when the single batch treatment of the high calcium content sodium slag is less than 10 kg; the twice roasting process may be used when the single batch treatment of the high calcium content sodium slag is larger than or equal to 10 kg and less than 100 kg. When the single batch treatment is larger than 100 kg, the high calcium content sodium slag may be divided into several parts and subjected to treatment, or be treated with a triple roasting processes.

Figure 2:
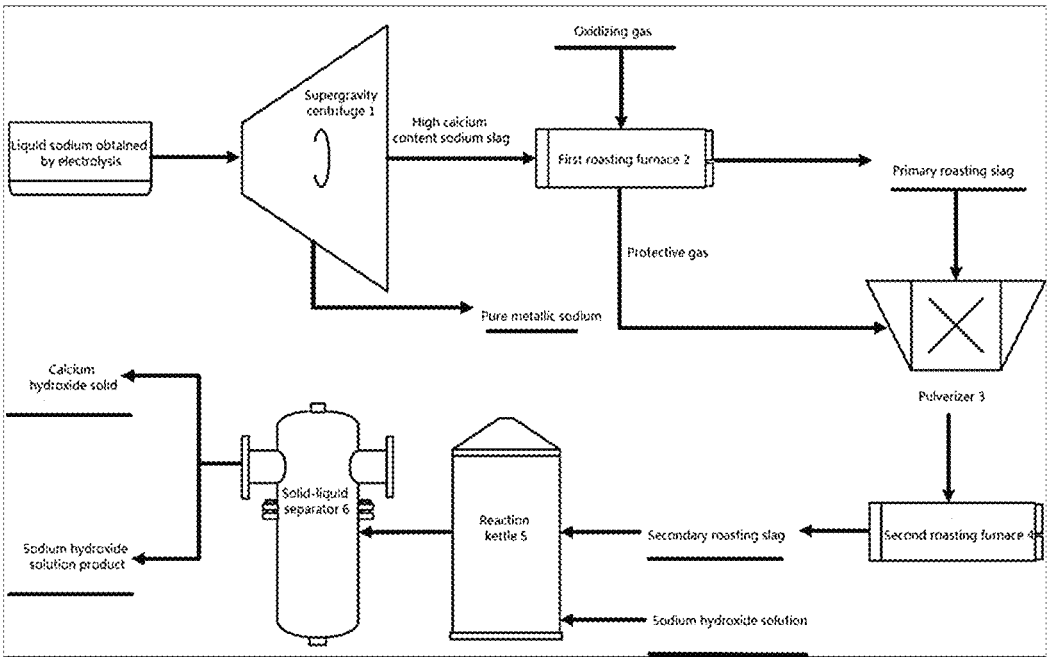
FIG. 2 illustrates a flow diagram of the centrifugation—Primary roasting—Primary pulverization—Secondary roasting—Primary leaching of the sodium metal of the present disclosure.

According to a preferred embodiment of the present disclosure, when the number of roasting process is 2 times or more, it is preferable after a single roasting, the roasting product is pulverized and then subjected to a next time of roasting, as shown in FIG. 2. A use of preferred embodiment may form the roasting slag with uniform granularity, improve safety of the process of leaching the roasting slag. The present disclosure is not particularly limited to the pulverization mode, for example, it may be mechanical crushing.

Preferably, the pulverization is performed to obtain a pulverized slag having a granularity of 10-160 mesh, further preferably 20-80 mesh, more preferably 20-60 mesh.

The present disclosure does not impose particular limitation to the specific rotation speed, time and number of pulverizations, as long as the pulverized slag with the above-described granularity can be obtained.

Preferably, the method further comprises recovering the tail gas in the roasting process (e.g., a first roasting), and providing the recovered tail gas (abbreviated as first roasting tail gas) with or without supplemental air or oxygen gas (depending on the oxidation state) to the subsequent roasting process as the roasting atmosphere. The tail gas obtained from the first roasting process is mainly consisting of nitrogen gas, which is collected and cooled and can be used as a protective gas used in subsequent pulverization processes or be used for diluting the concentration of oxygen gas in air, such an arrangement not only ensures safe operation of the roasting process, but also reduces cost.

Preferably, the pulverizing is performed under a protective atmosphere, which is provided by at least one of a roasting tail gas, nitrogen gas, helium gas, argon gas and neon gas. In order to reduce the cost of using the protective atmosphere during the pulverization process, it is preferable to select the roasting tail gas (e.g., the first roasting tail gas) for providing the protective atmosphere.

The inventors of the present disclosure have discovered during the course of their research that the segmented control of the roasting process is more advantageous for controlling the stable release of the combustion heat of the high calcium content sodium slag, and preventing the occurrence of bumping and splashing of the metal sodium droplets in the high calcium content sodium slag.

When there are two or more roasting processes, it is possible to perform the segmented control for each roasting process, or impose the segmented control on at least one roasting process. It is advantageous to achieve the above object as long as one of the roasting processes is subjected to the segmented control, the specific segmented control conditions of the two or more roasting processes may be the same or different, the present disclosure is not particularly limited thereto under the premise of ensuring the safe production.

Preferably, the roasting includes an initial roasting stage, a stable roasting stage and a finish roasting stage, wherein the temperature of each stage satisfies the relationship that the initial roasting stage<stable roasting stage<finish roasting stage.

More preferably, the conditions of the initial roasting stage comprises: an oxygen flow rate within a range of 0.5-30 $m^3$/t·min, more preferably 0.5-10 $m^3$/t·min, such as 0.5 $m^3$/t·min, 1 $m^3$/t·min, 2 $m^3$/t·min 3 $m^3$/t·min, 4 $m^3$/t·min, 5 $m^3$/t·min n, 6 $m^3$/t·min, 7 $m^3$/t·min, 8 $m^3$/t·min, 9 $m^3$/t·min, 10 $m^3$/t·min, or an arbitrary value between any two thereof, a roasting temperature within a range of 220-750° C., preferably 240-450° C., such as 240° C., 260° C., 300° C., 350° C., 400° C., 450° C., or an arbitrary value between any two thereof, an oxygen concentration within a range of 3-22%, preferably 5-20%, such as 5%, 10%, 15%, 20%, or an arbitrary value between any two thereof; and a roasting time within a range of 3-180 min, preferably 10-60 min, such as 10 min, 20 min, 30 min, 40 min, 50 min, 60 min, or an arbitrary value between any two thereof. Further preferably, the oxygen input is 20-60%, preferably 25-50%, of the theoretical oxygen consumption of the sodium slag in the initial roasting stage.

More preferably, the conditions of the stable roasting stage comprises: an oxygen flow rate within a range of 0.5-30 $m^3$/t·min, more preferably 0.5-10 $m^3$/t·min, such as 0.5 $m^3$/t·min, 1 $m^3$/t·min, 2 $m^3$/t·min 3 $m^3$/t·min, 4 $m^3$/t·min, 5 $m^3$/t·min n, 6 $m^3$/t·min, 7 $m^3$/t·min, 8 $m^3$/t·min, 9 $m^3$/t·min, 10 $m^3$/t·min, or an arbitrary value between any two thereof, a roasting temperature within a range of 220-750° C., preferably 300-500° C., such as 300° C., 350° C., 400° C., 450° C., 500° C., or an arbitrary value between any two thereof, an oxygen concentration within a range of 5-25%, preferably 10-25%, such as 10%, 15%, 20%, 25%, or an arbitrary value between any two thereof; and a roasting time within a range of 10-180 min, preferably 10-60 min, such as 10 min, 20 min, 30 min, 40 min, 50 min, 60 min, or an arbitrary value between any two thereof. Further preferably, the oxygen input is 20-50%, preferably 25-40%, of the theoretical oxygen consumption of the sodium slag in the stable roasting stage.

More preferably, the conditions of the finish roasting stage comprises: an oxygen flow rate within a range of 0.5-30 $m^3$/t·min, more preferably 0.5-10 $m^3$/t·min, such as 0.5 $m^3$/t·min, 1 $m^3$/t·min, 2 $m^3$/t·min 3 $m^3$/t·min, 4 $m^3$/t·min, 5 $m^3$/t·min n, 6 $m^3$/t·min, 7 $m^3$/t·min, 8 $m^3$/t·min, 9 $m^3$/t·min, 10 $m^3$/t·min, or an arbitrary value between any two thereof, a roasting temperature within a range of 220-750° C., preferably 300-500° C., such as 300° C., 350° C., 400° C., 450° C., 500° C., or an arbitrary value between any two thereof; an oxygen concentration within a range of 15-40%, preferably 15-30%, such as 15%, 20%, 22%, 24%, 26%, 28%, 30%, or an arbitrary value between any two thereof; and a roasting time within a range of 5-180 min, preferably 10-60 min, such as 10 min, 20 min, 30 min, 40 min, 50 min, 60 min, or an arbitrary value between any two thereof. Further preferably, the oxygen input is 10-40%, preferably 15-30%, of the theoretical oxygen consumption of the sodium slag in the finish roasting stage.

A use of the aforesaid segmented control of the roasting process is more conducive to releasing the heat generated in the roasting process and controlling the reaction temperature, and preventing the occurrence of thermal runaway and the residual of large amount of calcined metal sodium and calcium slag.

The foregoing content describe in detail the staged control of the single roasting process, the twice roasting process may or may not be subjected to the staged control. When the twice roasting process is subjected to the staged control, its staged control conditions may be the same with or different from, preferably the same with, the staged control conditions as described above for the single roasting process. When the twice roasting process is not subjected to the staged control, its control conditions may be same as those of the single roasting process is not subjected to the staged control, or may be same as those of a certain stage of the single roasting process is subjected to the staged control; preferably, the conditions of the twice roasting process are substantially identical with those of the finish roasting stage of the single roasting, the conditions specifically comprise: an oxygen flow rate within a range of 0.5-30 $m^3$/t·min, more preferably 0.5-10 $m^3$/t·min, such as 0.5 $m^3$/t·min, 1 $m^3$/t·min, 2 $m^3$/t·min 3 $m^3$/t·min, 4 $m^3$/t·min, 5 $m^3$/t·min n, 6 $m^3$/t·min, 7 $m^3$/t·min, 8 $m^3$/t·min, 9 $m^3$/t·min, 10 $m^3$/t·min, or an arbitrary value between any two thereof; a roasting temperature within a range of 220-750° C., preferably 300-500° C., such as 300° C., 350° C., 400° C., 450° C., 500° C., or an arbitrary value between any two thereof; an oxygen concentration within a range of 15-40%, preferably 15-30%, such as 15%, 20%, 22%, 24%, 26%, 28%, 30%, or an arbitrary value between any two thereof; and a roasting time within a range of 5-180 min, preferably 10-60 min, such as 10 min, 20 min, 30 min, 40 min, 50 min, 60 min, or an arbitrary value between any two thereof. Further preferably, the oxygen input is 10-40%, preferably 15-30%, of the theoretical oxygen consumption of the sodium slag in the finish roasting stage.

If the triple roasting process is further required, the specific operations and conditions are identical with those in accordance with the aforementioned principle, the content will not be repeatedly described herein.

The present disclosure has discovered by roasting, particularly after twice roasting processes, that the majority of the sodium and calcium components of the high calcium content sodium slag have been converted to sodium oxide and calcium oxide. Analysis of the hydration process of sodium oxide or calcium oxide has revealed that the hydration reactions are performed rapidly and accompanied with the generation of a large amount of heat, and in severe cases, cause splashing of an alkali liquor and bumping phenomenon, which increases the difficulty and safety hazard of the treatment process. The inventors have discovered through extensive researches that the hydration process of sodium oxide or calcium oxide depends on the amount of free water in the solution and the contact temperature. For example, since there are sodium hydroxide dihydrate and sodium hydroxide tetrahydrate in an aqueous solution of sodium hydroxide, the presence of these hydration actions greatly reduces the amount of free water in the solution, thus it is preferable in the present disclosure to hydrate the roasting slag with a hydrate, thereby safely leach the roasting slag. Preferably, a solute of the alkaline liquor in step (3) is a hydrate, preferably a sodium hydroxide hydrate and/or a calcium hydroxide hydrate, most preferably a sodium hydroxide hydrate, such as sodium hydroxide tetrahydrate and sodium hydroxide dihydrate.

According to a preferred embodiment of the present disclosure, the concentration of said alkaline liquor is within a range of 20-100 wt %, preferably within a range of 30-100 wt %, based on the hydroxide hydrate. For example, when the solute of the alkali liquor is sodium hydroxide tetrahydrate, the concentration of the alkali liquor in terms of NaOH is within a range of 11-36 wt %. A use of the preferred embodiment may cause that the roasting slag can be leached in a safer manner, such that the roasting slag is converted into a sodium hydroxide solution and calcium hydroxide mixture.

Preferably, a reaction temperature of the leaching is within a range of −18° C. to 45° C., further preferably −15° C. to 30° C., more preferably −15° C. to 10° C. A use of the preferred embodiment is more conducive to improving safety of the leaching process of roasting slag.

Preferably, a reaction time of the leaching is within a range of 10-300 min, more preferably 15-60 min, such as 15 min, 20 min, 30 min, 40 min, 50 min, 60 min, or an arbitrary value between any two thereof.

According to the present disclosure, it is preferred that the process further comprises subjecting the mixed material obtained from the leaching process to a solid-liquid separation to obtain a liquid (sodium hydroxide solution) and a solid (calcium hydroxide). More preferably, the method further comprises recycling at least part of said liquid to the leaching process for providing at least part of the alkaline liquor. In particular, a part of the concentrated sodium hydroxide solution therein may be used as a by-product, another part of the sodium hydroxide is supplemented with water content to convert into sodium hydroxide tetrahydrate and/or sodium hydroxide dihydrate, which is reused in the hydration process of the next batch of the secondary roasting slag.

The present disclosure uses the above process to efficiently and simultaneously implement the preparation of high purity metallic sodium and safe treatment of high calcium content sodium slag by directly subjecting the liquid sodium obtained from an electrolysis to supergravity separation and subsequently performing the roasting and leaching process.

The present disclosure will be described in detail below with reference to examples. The following examples serve to illustrate the continuous preparation process of high purity metallic sodium and the safe treatment method of high calcium content sodium slag provided by the present disclosure.

In the following examples, unless otherwise specified, the ingredients of liquid sodium, pure metallic sodium obtained and high calcium content sodium slag in step (1) and residual sodium calcium slag obtained in step (2) are expressed in terms of percentage content by weight, and the oxygen concentration in the oxygen-containing atmosphere is expressed in terms of volume percentage content.

Example 1

Figure 3:
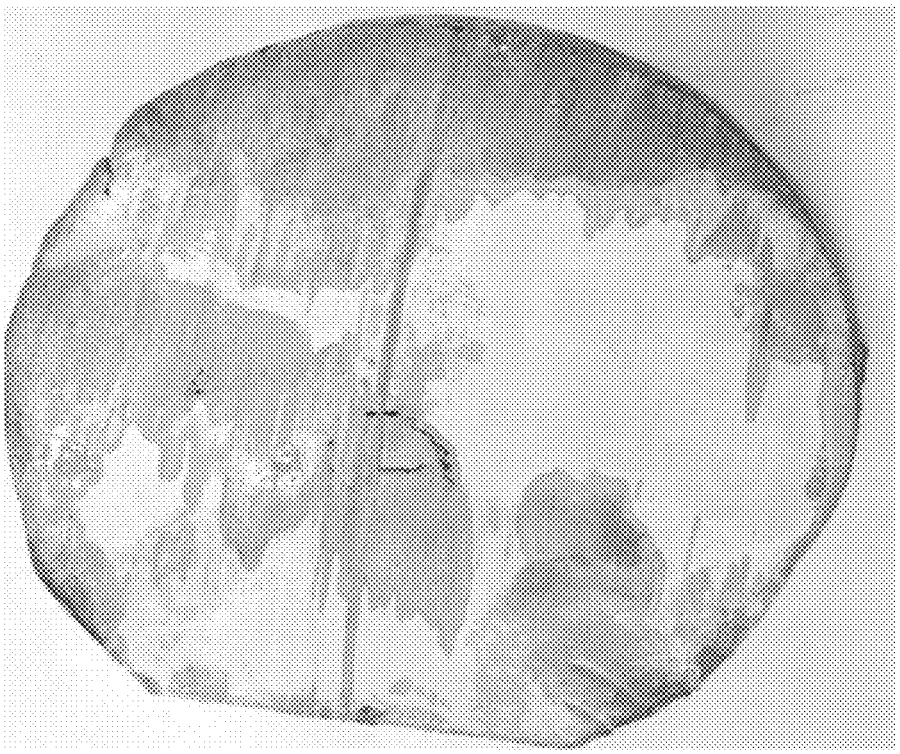
FIG. 3 shows a photograph of high purity metallic sodium obtained by centrifuging the Liquid sodium obtained by electrolysis in Example 1 of the present disclosure.
Figure 4:
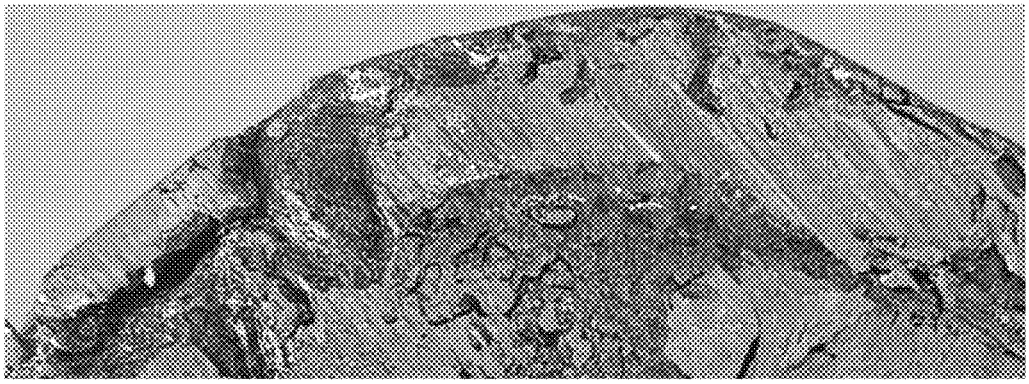
FIG. 4 shows a photograph of the high calcium content sodium slag after centrifugation in Example 1 of the present disclosure.
Figure 9:
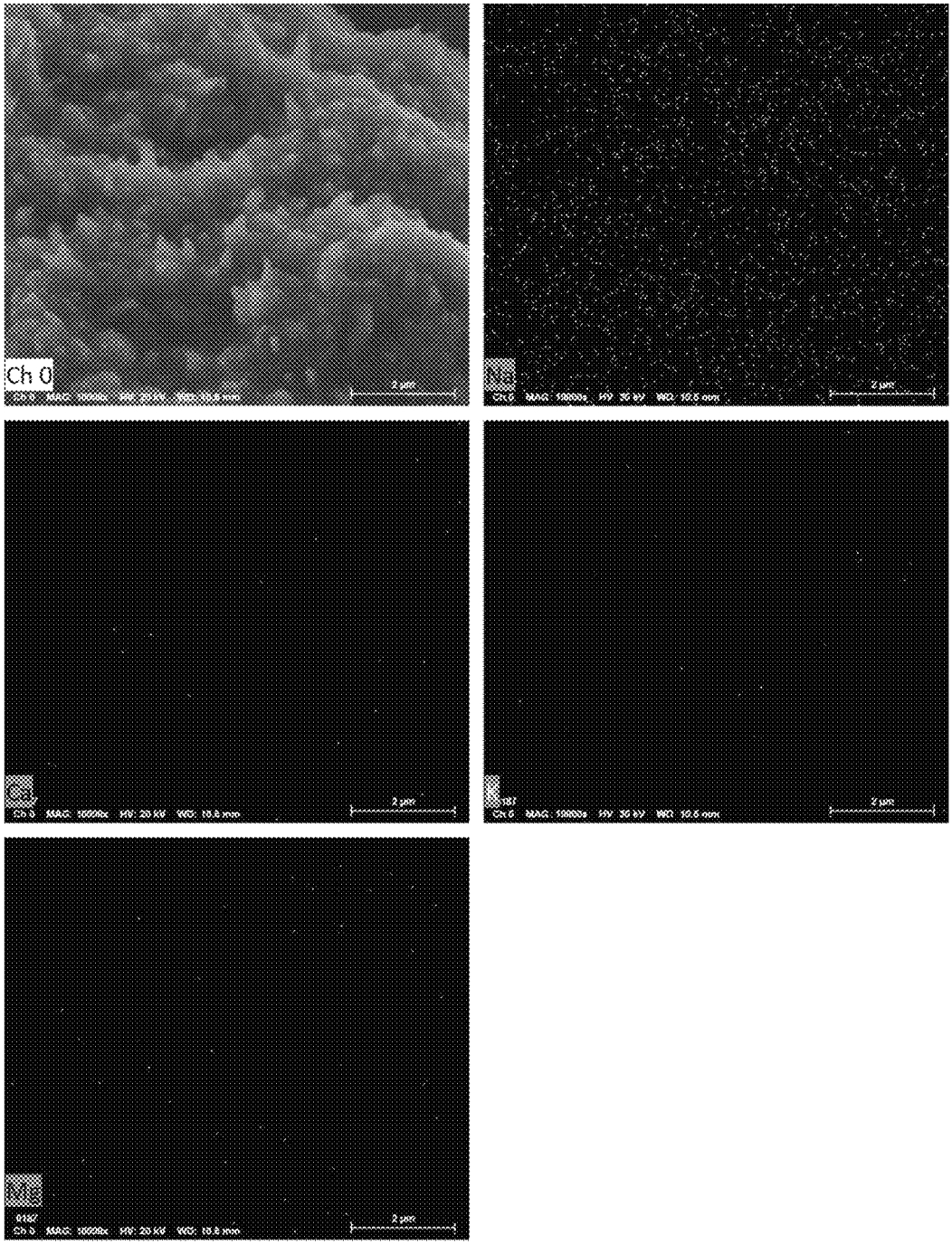
FIG. 9 shows Mapping photographs of the pure metallic sodium obtained by centrifuging the Liquid sodium obtained by electrolysis in Example 1 of the present disclosure.

(1) As shown in FIG. 2, 25 kg of the liquid sodium (containing Na in an amount of 99% and Ca in an amount of 1%) obtained from electrolysis and sampled from the factory was placed in a supergravity centrifuge for subjecting to centrifugation, the separation conditions were listed in Table 1, so as to obtain 24.32 kg of pure metallic sodium (with a sodium content of 99.95%) and 0.68 kg of high calcium content sodium slag (having a sodium content of 63% and a calcium content of 37%). The photographs of the pure metallic sodium and high calcium content sodium slag were shown in FIG. 3 and FIG. 4 respectively, and FIG. 9 illustrated a Mapping photograph of the pure metallic sodium.

Figure 5:
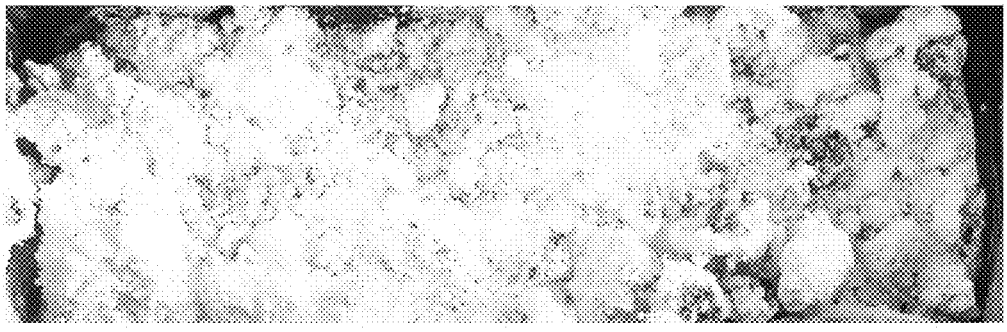
FIG. 5 is a photograph of roasting slag obtained after roasting the centrifuged high calcium content sodium slag in Example 1 of the present disclosure.

(2) The high calcium content sodium slag was subjected to a controllable oxygen roasting in a first roasting furnace (equipped with a first flowmeter for controlling the oxygen supply to the roasting furnace, similarly hereinafter), which was denoted as the first roasting, under the conditions listed in Table 2. Such that the sodium peroxide, sodium oxide, calcium oxide and residual un-oxidized sodium-calcium slag were obtained. Upon analysis, the residual amount of un-oxidized metal sodium and calcium was 5 wt. %. FIG. 5 illustrated a photograph of the roasting slag after roasting the centrifuged high calcium content sodium slag. The yellowish powder in the Figure was analyzed to be sodium peroxide. The white powder was mainly a mixture of sodium oxide and calcium oxide.

Figure 6:
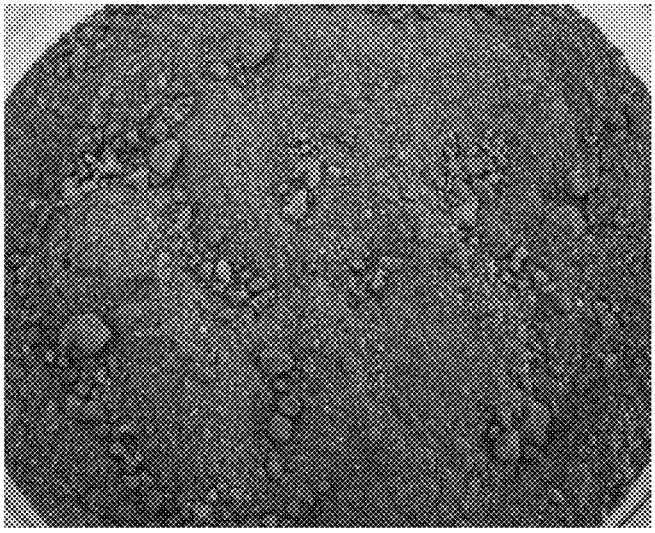
FIG. 6 shows a photograph of a pulverized slag after subjecting the high-calcium sodium slag in Example 1 of the present disclosure to a single roasting.

(3) The roasting slag obtained from step (2) was pulverized by a pulverizer at a pulverization rotation speed of 120 rpm and a pulverization time of 20 min, the pulverized roasting slag was sieved to obtain a roasting slag with a granularity of 60 mesh (FIG. 6). The protective gas of said pulverizer was nitrogen gas obtained from the primary roasting, and the pulverized roasting slag was put into a second roasting furnace for carrying out a controllable oxygen roasting, which was denoted as the secondary roasting, with the conditions listed in Table 2. About 0.92 kg mixture of sodium oxide and calcium oxide mixture was produced.

(4) The roasting product of step (3) was subjected to directional leaching (at a temperature of −10° C. for 20 minutes) in a reaction kettle by using 20 L concentrated sodium hydroxide tetrahydrate solution (equivalent to a mass percentage concentration by weight of NaOH about 35%), and subjected to separation in a solid-liquid separation apparatus to obtain concentrated sodium hydroxide solution and 0.43 kg of calcium hydroxide solid.

Figure 7:
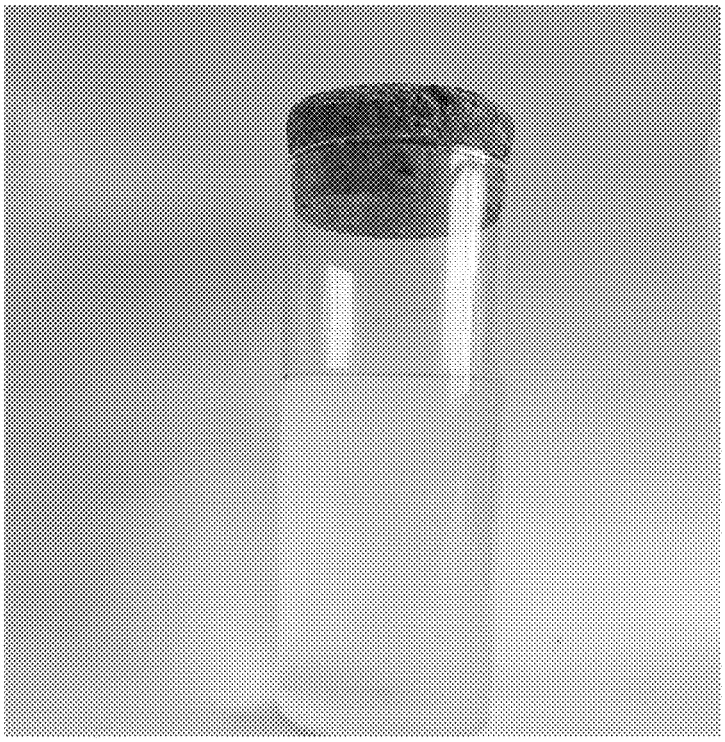
FIG. 7 is a photograph of a recovered sodium hydroxide solution obtained by leaching the roasting slag in Example 1 of the present disclosure.
Figure 8:
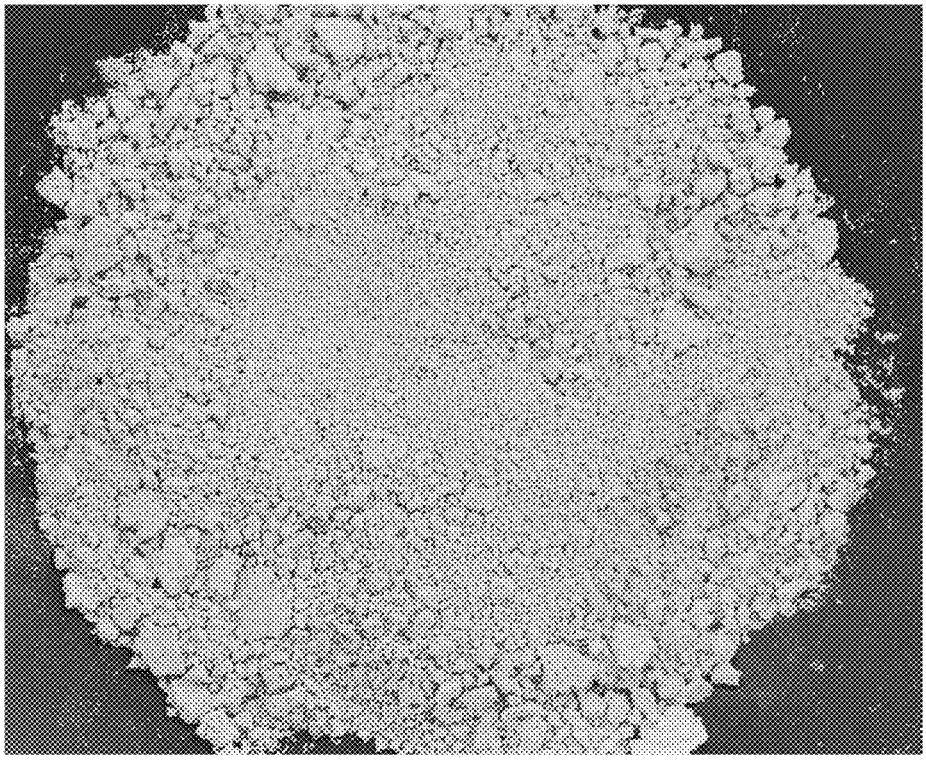
FIG. 8 shows a photograph of calcium hydroxide obtained by leaching the roasting slag in Example 1 of the present disclosure.

The concentrated sodium hydroxide leached solution was supplemented with 1.6 L of water, wherein 20 L of sodium hydroxide solution was spared for reuse in the next batch, about 1.4 L of the surplus sodium hydroxide solution was the product. In addition, the dilute alkali solution produced from washing the $Ca(OH)_2$ solid was used as dilution water for the next batch of concentrated NaOH leached solution. A portion of the concentrated NaOH alkali solution sample and the $Ca(OH)_2$ solid sample obtained after leaching the roasting slag were shown in FIG. 7 and FIG. 8, respectively.

Example 2

(1) As shown in FIG. 1, 1 kg of the liquid sodium (containing Na in an amount of 99% and Ca in an amount of 1%) obtained from electrolysis and sampled from the factory was placed in a supergravity centrifuge for subjecting to centrifugation, the separation conditions were listed in Table 1, so as to obtain 0.97 kg of pure metallic sodium (with a sodium content of 99.97%) and 0.03 kg of high calcium content sodium slag (having a sodium content of 66.3% and a calcium content of 33.6%).

(2) The high calcium content sodium slag was subjected to a controllable oxygen roasting in a first roasting furnace (equipped with a first flowmeter for controlling the oxygen supply to the roasting furnace, similarly hereinafter), which was denoted as the first roasting, under the conditions listed in Table 2. Then about 0.041 kg of roasting slag containing sodium peroxide, sodium oxide, calcium oxide, and residual sodium-calcium slag were obtained.

(3) The roasting product of step (2) was subjected to directional leaching (at a temperature of −5° C. for 20 minutes) in a reaction kettle by using 150 mL dilute sodium hydroxide tetrahydrate solution (equivalent to a mass percentage concentration by weight of NaOH about 25%), and subjected to separation in a solid-liquid separation apparatus to obtain concentrated sodium hydroxide solution and calcium hydroxide filter cake. The concentrated sodium hydroxide leached solution was supplemented with 100 mL of water, wherein 150 mL of sodium hydroxide solution was spared for reuse in the next batch, about 95 mL of the surplus sodium hydroxide solution was used as the sodium hydroxide solution product. The filter cake was washed and dried to obtain 18 g of calcium hydroxide solid, and the washing liquid may be used as a dilute alkali solution and returned to the next batch of the concentrated sodium hydroxide solution for dilution.

Example 3

(1) 1 kg of the same liquid sodium as in Example 2 was subjected to separation was carried out under the identical conditions to obtain the pure metallic sodium and high calcium content sodium slag.

(2) The high calcium content sodium slag was subjected to roasting under the same conditions as in Example 2 to obtain the roasting slag.

(3) The roasting product of step (2) was subjected to directional leaching (at a temperature of −5° C. for 20 minutes) in a leaching reaction kettle by further using 150 mL dilute sodium hydroxide tetrahydrate solution (equivalent to a mass percentage concentration by weight of NaOH about 25%), and subjected to separation in a solid-liquid separation apparatus to obtain concentrated sodium hydroxide alkali solution and calcium hydroxide filter cake. The concentrated sodium hydroxide alkali solution was diluted with 105 mL of the dilute sodium hydroxide solution generated from the washing process in Example 2, wherein 150 mL of sodium hydroxide solution was spared for reuse in the next batch, and about 100 mL of the surplus sodium hydroxide solution was used as the sodium hydroxide solution product. The filter cake was washed and dried to obtain 18 g of calcium hydroxide solid, and the washing liquid may be used as a dilute alkali solution and returned to the next batch of the concentrated sodium hydroxide solution for dilution.

Example 4

(1) 2 kg of the liquid sodium (containing Na in an amount of 99% and Ca in an amount of 1%) obtained from electrolysis and sampled from the factory was placed in a supergravity centrifuge for subjecting to centrifugation, the separation conditions were listed in Table 1, so as to obtain 1.94 kg of high purity metallic sodium (with a sodium content of 99.97%) and 0.06 kg of high calcium content sodium slag (having a sodium content of 65.0% and a calcium content of 35.0%).

(2) The high calcium content sodium slag was subjected to a controllable oxygen roasting in a first roasting furnace (equipped with a first flowmeter for controlling the oxygen supply to the roasting furnace, similarly hereinafter), which was denoted as the first roasting, under the conditions listed in Table 2. Then about 75 g of roasting slag consisting of the sodium peroxide, sodium oxide, calcium oxide and residual sodium-calcium slag were obtained.

(3) The roasting product of step (2) was subjected to directional leaching (at a temperature of 5° C. for 20 minutes) in a reaction kettle by using 300 mL concentrated sodium hydroxide tetrahydrate solution (equivalent to a mass percentage concentration by weight of NaOH about 33%), and subjected to separation in a solid-liquid separation apparatus to obtain concentrated sodium hydroxide solution and calcium hydroxide filter cake. The concentrated sodium hydroxide solution was diluted with 140 mL of water, wherein 300 mL of sodium hydroxide solution was spared for a use in the next batch, about 120 mL of the surplus sodium hydroxide solution was used as the sodium hydroxide solution product. The filter cake was washed and dried to obtain 70 g of calcium hydroxide solid, and the washing liquid may be used as a dilute alkali solution and returned to the next batch of the concentrated sodium hydroxide solution for dilution.

Example 5

(1) 3 kg of the liquid sodium (containing Na in an amount of 99% and Ca in an amount of 1%) obtained from electrolysis and sampled from the factory was placed in a supergravity centrifuge for subjecting to centrifugation, the separation conditions were listed in Table 1, so as to obtain 2.91 kg of high purity metallic sodium (with a sodium content of 99.97%) and 0.09 kg of high calcium content sodium slag (having a sodium content of 67% and a calcium content of 33%).

(2) The high calcium content sodium slag was subjected to a controllable oxygen roasting in a first roasting furnace (equipped with a first flowmeter for controlling the oxygen supply to the roasting furnace, similarly hereinafter), which was denoted as the first roasting, under the conditions listed in Table 2. Such that about 0.12 kg of roasting slag containing the sodium peroxide, sodium oxide, calcium oxide and residual sodium-calcium slag were obtained.

(3) The roasting product of step (2) was subjected to directional leaching (at a temperature of −3° C. for 10 minutes) in a reaction kettle by using 500 mL dilute sodium hydroxide tetrahydrate solution (equivalent to a mass percentage concentration by weight of NaOH about 20%), and subjected to separation in a solid-liquid separation apparatus to obtain concentrated sodium hydroxide solution and calcium hydroxide filter cake. The concentrated sodium hydroxide solution was supplemented with 420 mL of water, wherein 500 mL of sodium hydroxide solution was spared for a use in the next batch, about 400 mL of the surplus sodium hydroxide solution was used as the sodium hydroxide solution product. The filter cake was washed and dried to obtain about 0.05 kg of calcium hydroxide solid.

Example 6

(1) 50 kg of the liquid sodium (containing Na in an amount of 99% and Ca in an amount of 1%) obtained from electrolysis of sodium chloride was placed in a supergravity centrifuge for subjecting to centrifugation, the separation conditions were listed in Table 1, so as to obtain 48.6 kg of purity metallic sodium (with a sodium content of 99.95%) and 1.4 kg of high calcium content sodium slag (having a sodium content of 65% and a calcium content of 35%).

(2) The high calcium content sodium slag was subjected to a controllable oxygen roasting in a first roasting furnace (equipped with a first flowmeter for controlling the oxygen supply to the roasting furnace, similarly hereinafter), which was denoted as the first roasting, under the conditions listed in Table 2. The formed sodium peroxide, sodium oxide, calcium oxide and the residual un-oxidized sodium-calcium slag were obtained. The residual amount of un-oxidized metal sodium and calcium was analyzed to be about 10 wt %.

(3) The roasting slag obtained from step (2) was ball-milled through a pulverizer at a pulverization rotation speed of 120 rpm and a pulverizing time of 20 min, the pulverized roasting slag was sieved to obtain a roasting slag with a granularity of 60 mesh. The protective gas of said pulverizer was nitrogen gas obtained from the primary roasting, and the roasting slag was put into a second roasting furnace for carrying out a controllable oxygen roasting, which was denoted as the secondary roasting, with the conditions listed in Table 2. About 1.95 kg mixture of sodium oxide and calcium oxide mixture was obtained.

(4) The roasting product of step (3) was subjected to directional leaching (at a temperature of −10° C. for 20 minutes) in a reaction kettle by using 10 L concentrated sodium hydroxide tetrahydrate solution (equivalent to a mass percentage concentration by weight of NaOH about 30%), and subjected to separation in a solid-liquid separation apparatus to obtain concentrated sodium hydroxide solution and calcium hydroxide filter cake. The sodium hydroxide leached solution was subsequently added with 4 L of water for dilution, wherein 10 L of sodium hydroxide solution was spared for a use in the next batch, about 3.5 L of the surplus sodium hydroxide solution was used as the sodium hydroxide solution product. The filter cake was washed and dried to obtain 0.89 kg of calcium hydroxide solid.

TABLE 1

| Supergravity separation conditions | | | |
|---|---|---|---|
| | Separation factor Fr | Centrifugation time (min) | Centrifugation temperature (° C.) |
| Example 1 | 4,000 | 2 | 180 |
| Example 2 | 3,000 | 2 | 130 |
| Example 3 | 3,000 | 2 | 130 |
| Example 4 | 2,500 | 5 | 150 |
| Example 5 | 2,000 | 5 | 160 |
| Example 6 | 4,500 | 3 | 120 |

TABLE 2

| Controllable oxygen roasting conditions | | | | | | |
|---|---|---|---|---|---|---|
| | Example 1 | Example 2 | Example 3 | Example 4 | Example 5 | Example 6 |
| Initial stage of the first roasting | | | | | | |
| Temperature (° C.) | 250 | 250 | 250 | 250 | 280 | 250 |
| Time (min) | 20 | 30 | 30 | 30 | 30 | 30 |
| Oxygen flow rate ($m^3$/t · min) | 5 | 3 | 3 | 4 | 5 | 5 |
| Oxygen concentration (%) | 15 | 10 | 10 | 20 | 20 | 15 |
| Stable stage of the first roasting | | | | | | |
| Temperature (° C.) | 320 | 300 | 300 | 320 | 300 | 320 |
| Time (min) | 30 | 20 | 20 | 25 | 15 | 30 |
| Oxygen flow rate ($m^3$/t · min) | 3 | 5 | 5 | 5 | 6 | 2 |
| Oxygen concentration (%) | 15 | 15 | 15 | 20 | 20 | 15 |
| Finish stage of the first roasting, | | | | | | |
| Temperature (° C.) | 400 | 350 | 350 | 380 | 380 | 400 |
| Time (min) | 35 | 20 | 20 | 15 | 20 | 30 |
| Oxygen flow rate ($m^3$/t · min) | 2 | 5 | 5 | 4 | 5 | 3 |
| Oxygen concentration (%) | 15 | 20 | 20 | 20 | 20 | 15 |
| Initial stage of the second roasting | | | | | | |
| Temperature (° C.) | 250 | — | — | — | — | 250 |
| Time (min) | 20 | — | — | — | — | 20 |
| Oxygen flow rate ($m^3$/t · min) | 1 | — | — | — | — | 2 |
| Oxygen concentration (%) | 15 | — | — | — | — | 15 |
| Stable stage of the second roasting | | | | | | |
| Temperature (° C.) | 320 | — | — | — | — | 320 |
| Time (min) | 20 | — | — | — | — | 20 |
| Oxygen flow rate ($m^3$/t · min) | 0.5 | — | — | — | — | 3 |
| Oxygen concentration (%) | 15 | — | — | — | — | 15 |

TABLE 2-continued

| Controllable oxygen roasting conditions | | | | | | |
|---|---|---|---|---|---|---|
| | Example 1 | Example 2 | Example 3 | Example 4 | Example 5 | Example 6 |
| | Finish stage of the second roasting | | | | | |
| Temperature (° C.) | 400 | — | — | — | — | 400 |
| Time (min) | 20 | — | — | — | — | 20 |
| Oxygen flow rate ($m^3$/t · min) | 0.5 | — | — | — | — | 1 |
| Oxygen concentration (%) | 15 | — | — | — | — | 15 |

The above content describes in detail the preferred embodiments of the present disclosure, but the present disclosure is not limited thereto. A variety of simple modifications can be made in regard to the technical solutions of the present disclosure within the scope of the technical concept of the present disclosure, including a combination of individual technical features in any other suitable manner, such simple modifications and combinations thereof shall also be regarded as the content disclosed by the present disclosure, each of them falls into the protection scope of the present disclosure.

The invention claimed is:

1. A process for the preparation of high purity metallic sodium and the safe treatment of high calcium content sodium slag, the process comprises the following steps:

(1) subjecting a liquid sodium obtained from an electrolysis to a supergravity separation to obtain a high purity metallic sodium and a high calcium content sodium slag;

(2) subjecting said high calcium content sodium slag to at least one roasting process to obtain a roasting slag;

(3) leaching said roasting slag with an alkaline liquor to produce sodium hydroxide solution and calcium hydroxide, wherein the liquid sodium contains Na in an amount of 95-99.9 wt % and Ca in an amount of 0.1-5 wt %, based on the total amount of the liquid sodium, wherein the sodium content of the high purity metallic sodium is 99.8 wt % or more, wherein the high calcium content sodium slag contains Na and Ca, wherein Na is contained in an amount of 50-75 wt % and Ca is contained in an amount of 25-50 wt %, based on the total amount of named high calcium content sodium slag, wherein the at least one roasting process includes an initial roasting stage, a stable roasting stage, and a finish roasting stage, and wherein the temperature of each roasting stage satisfies the relationship that the initial roasting stage temperature <stable roasting stage temperature <finish roasting stage temperature.

2. The process of claim 1, wherein Na is contained in an amount of 98-99.7 wt % and Ca is contained in an amount of 0.3-2 wt %, based on the total amount of the liquid sodium.

3. The process of claim 1, wherein the conditions of the supergravity separation of step (1) comprise a separation factor within a range of 100-10,000, a separation time within a range of 0.1-100 min, and a separation temperature within a range of 100-420° C.

4. The process of claim 3, wherein the conditions of the supergravity separation of step (1) comprise a separation factor within a range of 500-4,500, a separation time within a range of 2-20 min, and a separation temperature within a range of 110-240° C.

5. The process of claim 1, wherein the roasting of step (2) is a controllable oxygen roasting, which enables a conversion of high calcium content sodium slag to sodium peroxide, sodium oxide, calcium oxide and residual sodium-calcium slag under the premise of satisfying the safe treatment.

6. The process of claim 1, wherein the conditions of roasting include a roasting temperature within a range of 220-750° C., wherein an oxygen flow rate during the roasting process is within a range of 0.5-50 m3/t·min, wherein an oxygen concentration during the roasting process is within a range of 5-40%, and wherein a roasting time is within a range of 5-180 min.

7. The process of claim 6, wherein the conditions of roasting include a roasting temperature within a range of 240-450° C., wherein an oxygen flow rate during the roasting process is within a range of 0.5-20 m3/t·min, wherein an oxygen concentration during the roasting process is within a range of 10-30%, and wherein a roasting time is within a range of 10-90 min.

8. The process of claim 1, wherein the number of roasting processes in step (2) is 1-4 times, wherein, if more than a first roasting is performed, the roasting product is pulverized after the first roasting and between subsequent roastings, and wherein the pulverization is performed to obtain a pulverized slag having a granularity of 10-160 mesh.

9. The process of claim 8, wherein the pulverization is performed to obtain a pulverized slag having a granularity of 20-80 mesh.

10. The process of claim 1, wherein a pulverization is carried out under a protective atmosphere, which is provided by at least one of roasting tail gas, nitrogen gas, helium gas, argon gas and neon gas, after a first roasting process.

11. The process of claim 10, wherein the protective atmosphere is provided by the roasting tail gas.

12. The process of claim 1, wherein the conditions of the initial roasting stage comprise: an oxygen flow rate within a range of 0.5-30 m3/t·min, a roasting temperature within a range of 220-750° C., an oxygen concentration within a range of 3-22%, and a roasting time within a range of 3-180 min, wherein the conditions of the stable roasting stage comprise: an oxygen flow rate within a range of 0.5-30 m3/t·min, a roasting temperature within a range of 220-750° C., an oxygen concentration within a range of 5-25%, and a roasting time within a range of 10-180 min, and wherein the conditions of the finish roasting stage comprise: an oxygen flow rate within a range of 0.5-30 m3/t·min, a roasting temperature within a range of 220-750° C., an oxygen concentration within a range of 15-40%, and a roasting time within a range of 5-180 min.

13. The process of claim 12, wherein the conditions of the initial roasting stage comprise: an oxygen flow rate within a range of 0.5-10 m3/t·min, a roasting temperature within a range of 240-450° C., an oxygen concentration within a range of 5-20%, and a roasting time within a range of 10-60 min, wherein the conditions of the stable roasting stage comprise: an oxygen flow rate within a range of 0.5-10 m3/t·min, a roasting temperature within a range of 300-500° C., an oxygen concentration within a range of 10-25%, and a roasting time within a range of 10-60 min, and wherein the conditions of the finish roasting stage comprise: an oxygen flow rate within a range of 0.5-10 m3/t·min, a roasting temperature within a range of 300-500° C., an oxygen concentration within a range of 15-30%, and a roasting time within a range of 10-60 min.

14. The process of claim 1, wherein a solute of the alkaline liquor in step (3) is a hydrate, wherein the concentration of said alkaline liquor is within a range of 20-100 wt %, based on the hydroxide hydrate, wherein a reaction temperature of the leaching is within a range of −18° C. to 45° C., and wherein a reaction time of the leaching is within a range of 10-300 min.

15. The process of claim 14, wherein a solute of the alkaline liquor in step (3) is a sodium hydroxide hydrate and/or a calcium hydroxide hydrate.

16. The process of claim 15, wherein a solute of the alkaline liquor in step (3) is a sodium hydroxide hydrate.

17. The process of claim 14, wherein the concentration of said alkaline liquor is within a range of 30-100 wt %, based on the hydroxide hydrate, wherein a reaction temperature of the leaching is within a range of −15° C. to 30° C., and wherein a reaction time of the leaching is within a range of 15-60 min.

18. The process of claim 1, wherein the process further comprises subjecting the leached material to a solid-liquid separation to obtain a liquid and a solid, the method further comprising recycling at least part of said liquid to the leaching process for providing at least part of the alkaline liquor.

* * * * *